US005434391A

United States Patent [19]

Eke

[11] Patent Number: 5,434,391

[45] Date of Patent: Jul. 18, 1995

[54] MICROWAVE OVEN WITH CO-LOCATED MICROWAVE AND HOT AIR LAUNCH SITE

[75] Inventor: Kenneth I. Eke, Woldingham, United Kingdom

[73] Assignee: Microwave Ovens Limited, Shirley, United Kingdom

[21] Appl. No.: 193,086

[22] PCT Filed: Aug. 3, 1992

[86] PCT No.: PCT/GB92/01424

§ 371 Date: Mar. 11, 1994

§ 102(e) Date: Mar. 11, 1994

[87] PCT Pub. No.: WO93/03309

PCT Pub. Date: Feb. 18, 1993

[30] Foreign Application Priority Data

Aug. 7, 1991 [GB] United Kingdom ..... 9116998

[51] Int. Cl.[6] ..... H05B 6/72

[52] U.S. Cl. ..... 219/681; 219/746; 219/750

[58] Field of Search ..... 219/681, 685, 745, 746, 219/748, 750, 756, 757

[56] References Cited

U.S. PATENT DOCUMENTS

| | | | |
|---|---|---|---|
| 3,235,701 | 2/1966 | Duras et al. | 219/745 |
| 3,884,213 | 5/1975 | Smith | 219/681 |
| 4,480,164 | 10/1984 | Dills | 219/681 |
| 4,481,396 | 11/1984 | Matsubayashi et al. | 219/681 |
| 4,691,088 | 9/1987 | Eke | 219/681 |
| 4,940,869 | 7/1990 | Scholtes et al. | 219/681 |

*Primary Examiner*—Philip H. Leung

*Attorney, Agent, or Firm*—Lee, Mann, Smith, McWilliams, Sweeney & Ohlson

[57] ABSTRACT

A microwave oven has a food-receiving cavity the rear panel of which is apertured to provide a launch area for the entry of microwave power to the cavity from a magnetron. A metal plate is positioned in front of a launch area, a central area of the plate having apertures. A forced hot air system comprising a fan and an electrical resistance heating element are positioned between the launch area and the plate. In use, the plate acts as a baffle plate for the hot air system and also as a mismatch plate for the microwave power, so that the dielectric load of food items placed in the cavity determines the microwave power coupled to the loaded oven from the magnetron.

5 Claims, 1 Drawing Sheet

MICROWAVE OVEN WITH CO-LOCATED MICROWAVE AND HOT AIR LAUNCH SITE

FIELD OF THE INVENTION

This invention relates to microwave ovens, and in particular to such ovens having magnetrons for delivering microwave power to the oven cavities and forced hot air systems for re-circulating hot air through the cavities.

BACKGROUND OF THE INVENTION

The applicants' U.S. Pat. No. 4,691,088 discloses a microwave oven having a magnetron for delivering microwave power to the oven cavity and a forced hot air system for re-circulating hot air through the cavity. The microwave energy is delivered to the cavity through a launch area in the base of the cavity. A metal turntable is supported in the cavity above the launch area so that the oven when devoid of food provides an inefficient power match with the magnetron, whereby the dielectric load of food items placed in the oven determines the power coupled to the loaded oven from the magnetron. The oven has a hot air system which re-circulates hot air through the oven cavity by means of inlet and outlet apertures in the rear wall of the cavity. The invention stems from the realisation that advantages can be gained if the microwave energy and the hot air can be delivered into the cavity from the same site.

DISCLOSURE OF THE INVENTION

According to the invention a microwave oven comprises a cavity, a magnetron for delivering microwave power to the cavity through a launch area, a forced hot air system comprising an electrical resistance heating element and a fan for forcing air over the element and through the cavity, a metal plate supported in the cavity so that a front surface of the plate faces into the cavity and a rear surface of the plate faces the launch site, the metal plate having peripheral edges spaced from the cavity walls so that the oven when devoid of food provides an inefficient power match with the magnetron, whereby the dielectric load of food items placed in the oven determines the power-coupled to the loaded oven from the magnetron, the forced flow of air re-circulating around the plate which thereby serves as a baffle plate for the hot air system and as a mis-match plate for the microwave power.

The launch area is preferably in a rear panel of the cavity. This has the particular advantage that the base panel of the oven can be left unobstructed, making for easy cleaning. Alternatively, the launch area may be in the top panel or one of the walls of the cavity.

The fan and the electrical resistance heating element are preferably positioned between the metal plate and the rear panel of the cavity, with the fan preferably being surrounded by the heating element.

The plate is preferably centrally apertured so that air is drawn into central apertures in the plate, then passes over the heating element and around the edges of the plate to be re-circulated through the cavity.

A microwave oven according to the invention will now be described by way of example with reference to the accompanying drawings in which.

Figure 1:
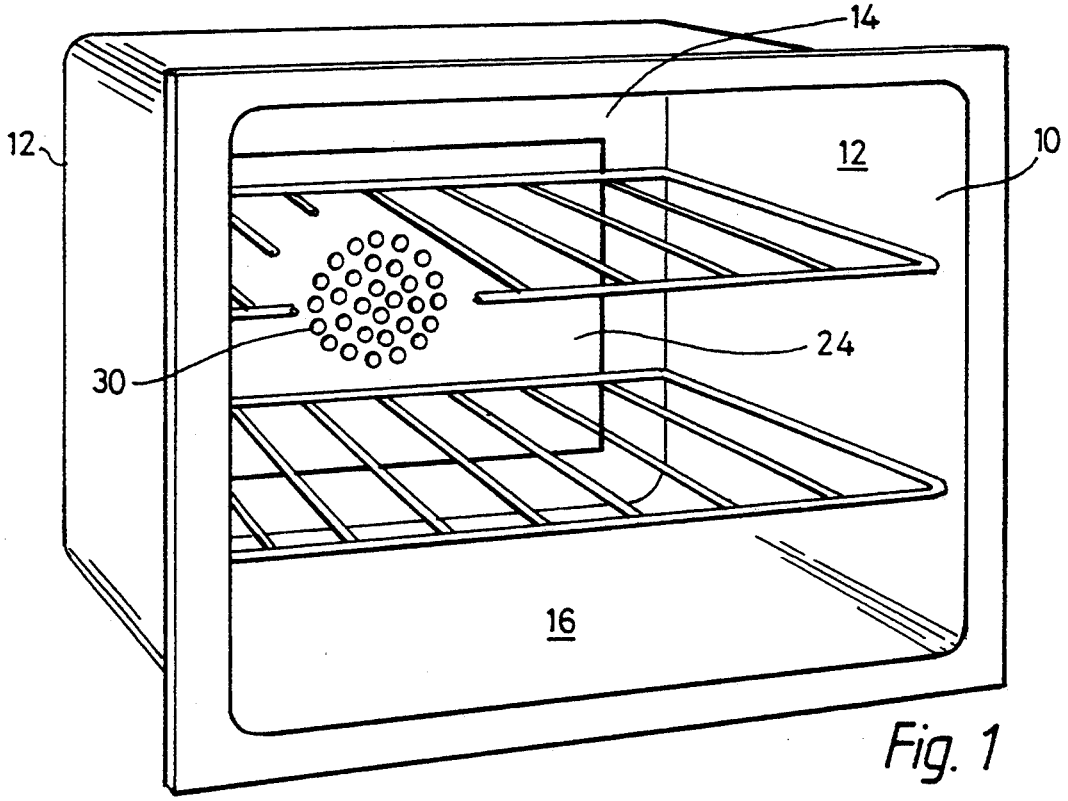
FIG. 1 is a perspective view of the oven with a front door removed.

The oven has a cavity 10 defined by two side walls 12, a rear panel 14, a base panel 16 and a top panel. The microwave oven has a magnetron (not shown) which delivers microwave power through a passage 18 and thence through a launch site or area 20 into the cavity. A rotatable member 22 acts as a mode stirrer to prevent the setting up of standing waves in the cavity 10.

A vertical metal plate 24 is positioned in the cavity so that it is spaced a short distance in front of the rear panel 14. The plate 24 is generally rectangular and its outer edges are spaced from the walls 12 and the base and top panels of the cavity, so that there is all-round clearance between the edges of the plate 24 and the structure defining the cavity. The positioning of the plate 24 is such that the plate 24 presents to the magnetron a load which is a poor match with respect to the magnetron. As a result, the amount of power delivered by the magnetron to the empty oven is small, and this low degree of power coupling can be demonstrated on a Rieke diagram.

Figure 2:
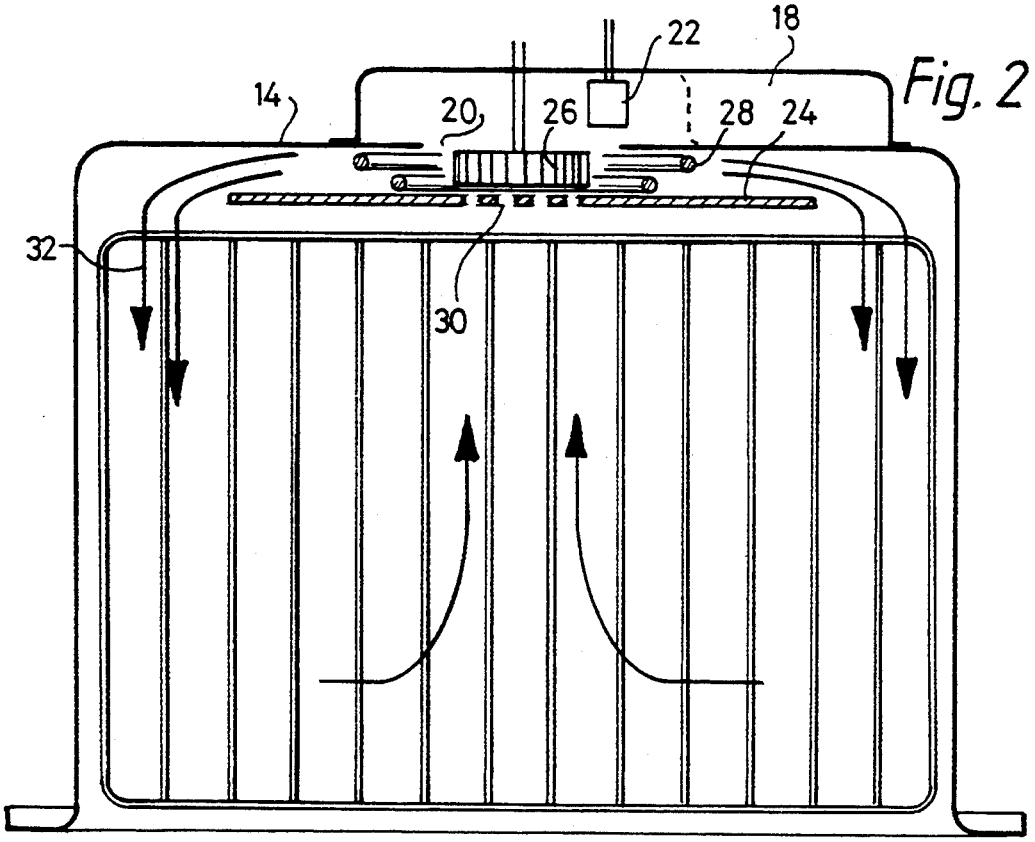
FIG. 2 is a sectional plan view through the oven.

A fan 26, rotatable about a horizontal axis, is positioned immediately behind the plate 24, and the fan 26 is surrounded by an electrical resistance heating element 28. Hence, as can be seen from FIG. 2, the fan 26 and the element 28 are positioned between the plate 24 and the launch area 20. The central area of the plate 24 has a series of apertures 30 and the fan acts to force a flow of heated air through the oven cavity as illustrated by the arrows 32. The air is expelled around the outer edges of the plate 24, passes towards the front of the cavity and is then sucked centrally and rearwardly through the apertures 30, to be re-circulated and heated over the element 28.

The plate 24 therefore acts as a baffle plate for the forced hot air system. In addition, the plate 24 acts as a mis-match plate in the manner described in U.S. Pat. No. 4,691,088. Hence, if a food item is placed on either wire rack 34 of the oven, the effectivenes of microwave coupling is slightly increased and the food item absorbes microwave power in accordance with its dielectric properties.

The fan 26 and mode stirrer 22 can be driven from a common drive shaft, with appropriate step-down gearing in the drive to the mode stirrer 22. Instead of being driven by a shaft drive, the mode stirrer 22 may be constructed such that the air flow delivered by the fan impinges on blades of the mode stirrer 22 in order to rotate the latter.

It will be appreciated that the plate 24 need not be entirely of metal, but it must have sufficient metal content (e.g. by an external metal coating or an internal metal layer) which enables it to act as a mis-match plate for the microwave power delivered into the cavity from the launch area 20.

I claim:

1. A microwave oven comprising a cavity having walls, a magnetron for delivering microwave power to the cavity through a launch area, a forced hot air system comprising an electrical resistance heating element and a fan for forcing air over the heating element and through the cavity, a metal plate supported in the cavity so that a front surface of the plate faces into the cavity and a rear surface of the plate faces the launch area, the fan being positioned between the metal plate and a rear wall of the cavity, the metal plate having peripheral edges spaced from the cavity walls so that there is an all-round clearance gap between the peripheral edges of the metal plate and the cavity walls, the microwave power passing through said all-round clearance gap to reach the cavity from the launch area, wherein the metal plate is apertured by virtue of having central aperture means and the fan is operative to draw air from the cavity through the central aperture means and thence to direct the air through the clearance gap so as to recirculate the air to the cavity, the metal plate having a thickness and the central aperture means being dimensioned substantially to prevent the passage of microwave power through the aperture means, whereby in use the metal plate serves as a baffle plate for the hot air system and as a mis-match plate for the microwave power.

2. A microwave oven according to claim 1, wherein the launch area is in a rear panel of the cavity.

3. A microwave oven according to claim 2, wherein the fan and the electrical resistance heating element are positioned between the metal plate and the rear panel of the cavity.

4. A microwave oven according to claim 3, wherein the fan is surrounded by the heating element.

5. A microwave oven according to claim 1 wherein the plate is centrally apertured so that air is drawn into central apertures in the plate, then passes over the heating element and around the edges of the plate to be recirculated through the cavity.

* * * * *